US011079198B2

(12) United States Patent
Wood

(10) Patent No.: US 11,079,198 B2
(45) Date of Patent: Aug. 3, 2021

(54) LATCHING LOADER MECHANISM WITH GATED FEED

(71) Applicant: Planet Eclipse UK Limited, Manchester (GB)

(72) Inventor: Jack Kingsley Wood, Snelson (GB)

(73) Assignee: Planet Eclipse UK Limited, Trafford Park (GB)

( * ) Notice: Subject to any disclaimer, the term of this patent is extended or adjusted under 35 U.S.C. 154(b) by 0 days.

(21) Appl. No.: 16/877,659

(22) Filed: May 19, 2020

(65) Prior Publication Data

US 2020/0370861 A1 Nov. 26, 2020

Related U.S. Application Data

(60) Provisional application No. 62/850,732, filed on May 21, 2019.

(51) Int. Cl.
*F41B 11/50* (2013.01)
*F41B 11/52* (2013.01)

(52) U.S. Cl.
CPC ..... *F41B 11/52* (2013.01); *F41B 11/50* (2013.01)

(58) Field of Classification Search
CPC ..... F41B 11/52; F41B 11/50; F41B 11/70
USPC ..... 124/45, 49, 50
See application file for complete search history.

(56) References Cited

U.S. PATENT DOCUMENTS 2,745,920 A * 5/1956 Keephart ..... G01F 23/185 200/61.21
4,102,124 A * 7/1978 Swager ..... F16G 15/06 403/154
2003/0131835 A1* 7/2003 Rice ..... F41B 11/52 124/49
2003/0171158 A1* 9/2003 Lee ..... A63B 57/0006 473/137
2004/0074488 A1 4/2004 Ho et al.
2006/0032488 A1* 2/2006 Telford ..... F41B 11/52 124/82
2007/0023024 A1* 2/2007 Yeh ..... F41B 11/53 124/49
2011/0226226 A1* 9/2011 Isabelle ..... F41B 11/57 124/45
2015/0027426 A1* 1/2015 Isabelle ..... F41B 11/52 124/49

(Continued)

FOREIGN PATENT DOCUMENTS

DE 1933649 B1 11/1970

*Primary Examiner* — John E Simms, Jr.
(74) *Attorney, Agent, or Firm* — Barlow Joseph and Holmes Ltd; David Josephs

(57) ABSTRACT

The latching/locking loader mechanism of the present invention provides a quick-release latch mechanism where a user can unlock and lock the attachment of the loader to the paintball gun quickly and easily without the use of tools. The latching/locking mechanism stays locked or unlocked without further use of tools. A spring-biased gate is provided in the path of the paintballs, namely, in the feed neck of the loader. When the loader is installed on the paintball marker, via a feed collar, deflection posts on the feed collar push the gate out of the paintball path in the feed neck of the loader so that paintballs may freely pass from the storage chamber of the loader and then into the breech of the paintball marker. When not installed on a feed collar, the gate blocks the path of paintballs.

15 Claims, 21 Drawing Sheets

(56) References Cited

U.S. PATENT DOCUMENTS

2015/0241164 A1* 8/2015 Hsu ..... F41B 11/51
124/51.1

* cited by examiner

LATCHING LOADER MECHANISM WITH GATED FEED

CROSS REFERENCE TO RELATED APPLICATIONS

This application is related to, and claimed benefit from, U.S. Provisional Application No. 62/850,732, filed May 21, 2019, entitled "LATCHING LOADER MECHANISM WITH GATED FEED," incorporated by reference in entirety herein.

BACKGROUND OF THE INVENTION

The present disclosure relates to a paintball marker loading system and method, and in particular to an improved latching or locking interface between the loader and paintball marker.

In the sport of paintball and other sports for launching projectiles, a projectile launcher, such as a paintball marker, is used to propel spherical paintballs towards a target and a paintball loader, or hopper, is used to hold a quantity of paintballs and to supply those paintballs to the paintball marker. For ease of discussion, the present invention is discussed in connection with paintball markers but the invention is also related and applicable to other projectile launching devices, such as airsoft guns. Traditionally, the paintball is fired with pressurized gas that is expelled through, for example, a bolt. In use, the paintball is loaded into the breech, the bolt is pressed against the paintball such that the face of the bolt is in contact with the rear of the paint ball. The air passed through the breech to force the paintball through the barrel of the marker.

Hoppers or loaders are well known to feed a supply of paintballs into the breech of a paintball marker. Typically, paintballs are inserted into the loader. The loader is then attached to a top side of the paintball marker where a direct pass-through is provided between the chamber of the loader and the breech of the paintball marker so that paintballs may freely flow from the loader into the breech by gravity. The loader is typically secured to the top of the paintball marker by some type of clamp or other releasable mechanism. However, these loaders are often difficult to quickly remove and replace as is often required during gameplay. For example, there is a need to quickly remove an empty loader and replace it with a second spare loader that is pre-filled with paintballs to avoid extended interruptions in game play.

Also, since the loaders include an open free path for the paintballs to travel from the chamber of the loader, through the feed neck and then into the breech of the marker, care must be taken when installing a loader that is filled with paintballs. More specifically, during the handling and installation of the second, there is a need to invert the loader so its feed neck can be mated with the feed collar on the paintball marker. During this inversion, it is possible that paintballs may undesirably fall out of the loader through the feed neck.

For the foregoing reasons, there is a need for a loader mechanism that is easy and quick to install and remove. There is also a need to provide a loader mechanism that can prevent the unwanted falling out of paintballs when the loader is not installed on a paintball marker.

SUMMARY OF THE INVENTION

The latching/locking loader mechanism of the present invention provides a quick-release latch mechanism where a user can unlock and lock the attachment of the loader to the paintball gun quickly and easily without the use of tools. The latching/locking mechanism stays locked or unlocked without further use of tools.

The present invention additionally, or alternatively, provides a reliable and secure mechanism to prevent unwanted unloading of the hopper upon inversion to install into a paintball marker. For example, a spring-biased gate can be provided in the path of the paintballs, namely, in the feed neck of the loader. In an uninstalled state, the spring-biased gate can prevent paintballs from freely flowing through the neck of the loader due to, for example, gravity. When the loader/hopper is installed on the paintball marker, via a feed collar, deflection posts on the feed collar can push the spring-biased gate out of the paintball path in the feed neck of the loader so that paintballs may freely pass from the storage chamber of the loader and then into the breech of the paintball marker. Separation or disconnection of the loader from the paintball marker can result in the deflection posts being disengaged with the spring-biased gate thereby permitting the gate to again reside in the path of the paintballs in the loader to prevent the paintballs from undesirably exiting the loader.

BRIEF DESCRIPTION OF THE DRAWING FIGURES

The novel features that are characteristic of the present disclosure are set forth in the appended claims. However, the disclosure's preferred embodiments, together with further objects and attendant advantages, will be best understood by reference to the following detailed description taken in connection with the accompanying drawings in which:

DESCRIPTION OF THE INVENTION

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like proximal, distal, top, bottom, up, or down are used, they are not intended to limit the systems, devices, and methods disclosed herein. A person skilled in the art will recognize that these terms are merely relative to the system and device being discussed and are not universal. Further, for ease of discussion, the present invention is discussed in connection with paintball markers, but the invention is also related and applicable to other projectile launching devices, such as airsoft guns.

Figure 1:
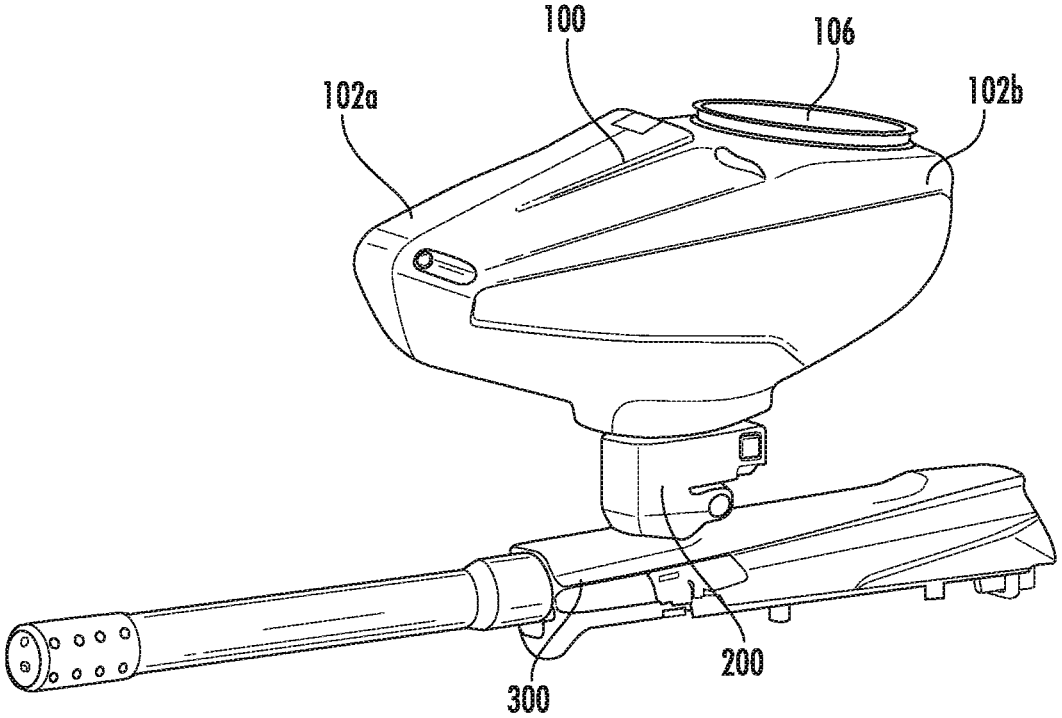
FIG. 1 shows a fully installed loader on a paintball marker using the latching/locking mechanism and loader and feed collar interface of the present invention.

Turning first to FIG. 1, a loader 100 is fully installed on a paintball marker 300 using the instant feed collar interface 200. In general, the feed collar is affixed to the top of the paintball marker at the feed port 302 into the breech 304. The unique feed collar 200 can interface with the loader 100 to provide for selective locking to the loader 100. The loader 100 itself can be configured to prevent paintballs 400 from falling out when the loader 100 is not connected to the paintball marker 300 via the feed collar 200.

Figure 2:
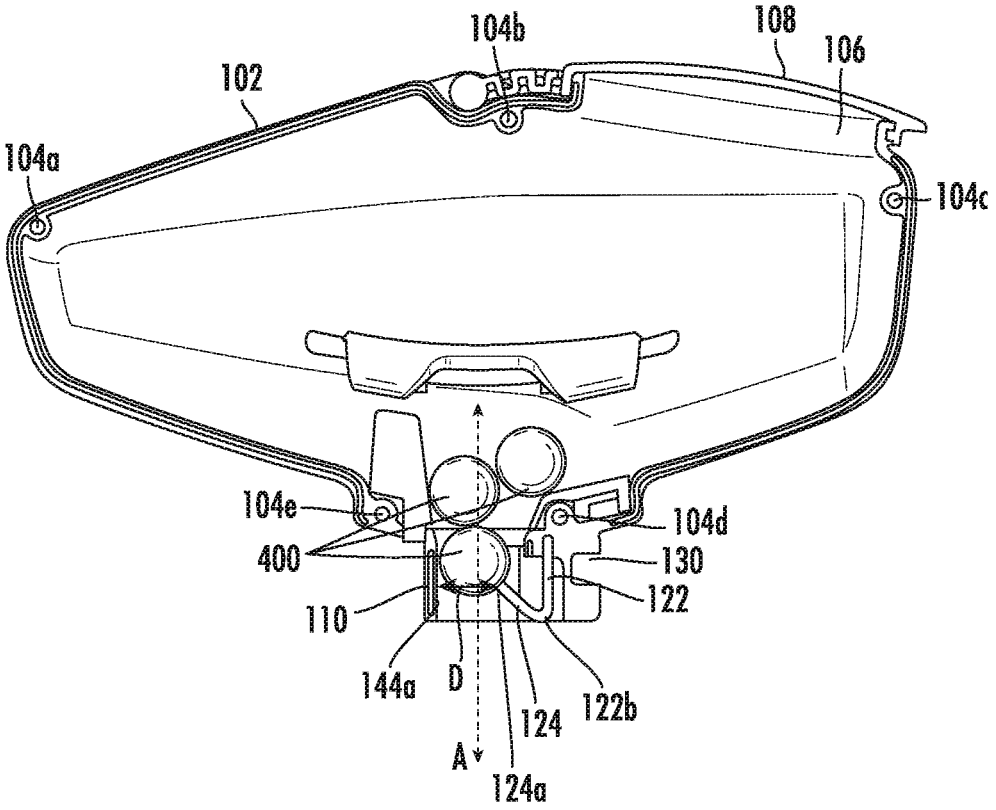
FIG. 2 is a cross-sectional view of the loader of the present invention while not install on a marker.

The loader 100 can, in general, be formed as a single unit which can accommodate a plurality of paintballs 400 in a hopper 102 which can be expelled from the attached marker 300. In some embodiments, the loader 100 can be formed from two hemispheres, or halves, a first side 102*a* and a second, mirrored, side 102*b*. The two halves 102*a*, 102*b* can be secured to one another via a plurality of fasters (not shown), such as screws. In the illustrated embodiment, as shown in FIG. 2, the screws are threaded through a plurality of through holes 104*a-e*, though any number of through holes and screws can be used. In one alternative embodiment, the two halves 102*a-b* can be secured to one another via any known mechanical fastener or adhesive. Alternatively, the loader 100 can be formed as a single integral piece, via e.g. injection molding. In some embodiments, the hopper 102 can include a paintball feed opening 106 at the top of the hopper 102 to allow for additional paintballs to be introduced into the hopper 102. The paintball feed opening 106 can be closed by a pivotable door 108. The loader 100 can be formed of any suitable material, including metal and plastics. The hopper 102 can accommodate any number of paintballs 400 and can have any shape.

Figure 3:
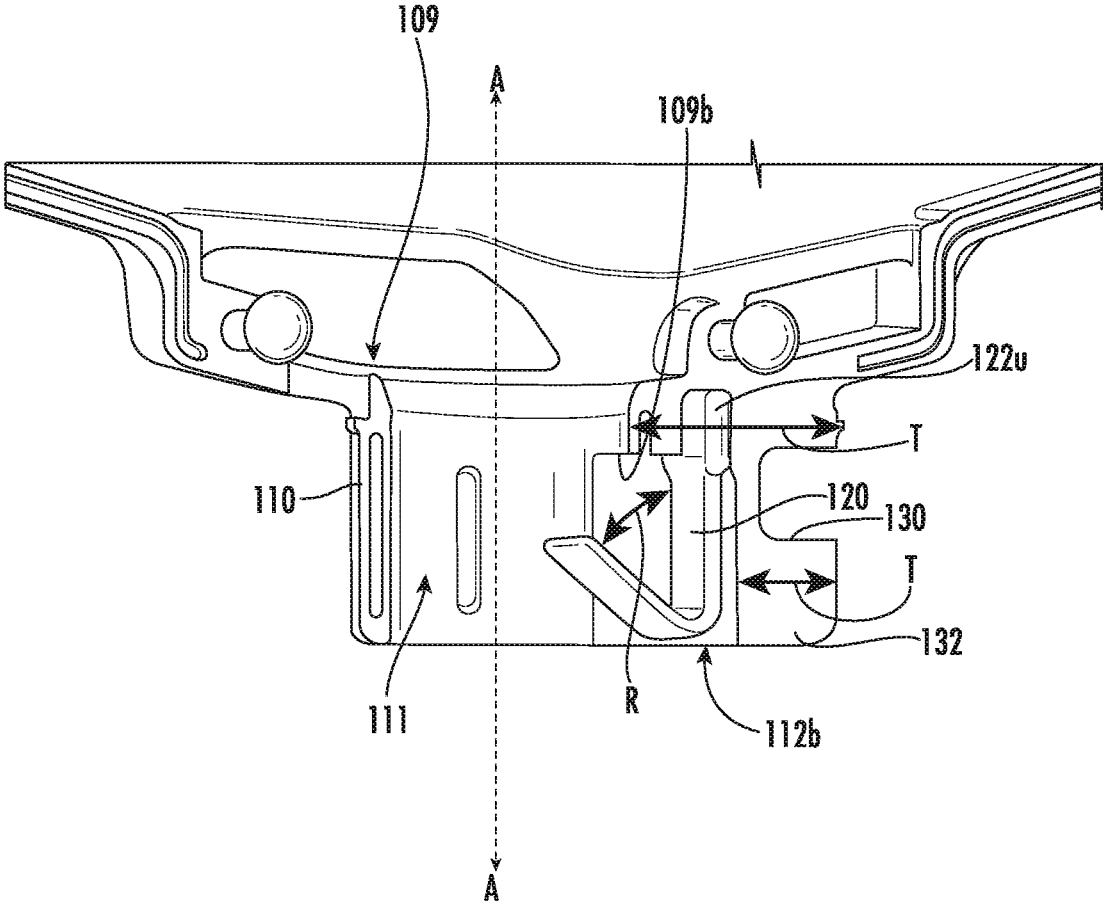
FIG. 3 is a close up perspective view of the loader neck and spring-biased gate of the present invention.
Figure 4:
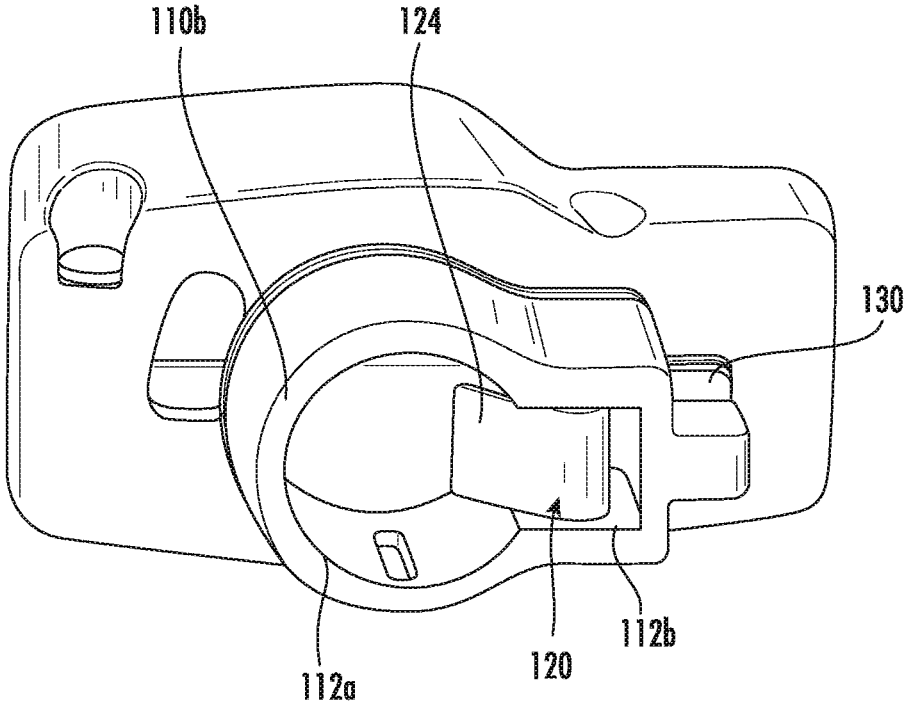
FIG. 4 is bottom perspective view of the loader neck and spring-biased gate of the present invention.

Extending downward from the lower end 109 of the hopper 102 is a neck 110, as best seen in FIG. 3. The neck 110 of the loader 100 can be sized and shaped to be received within the feed collar 200 such that the hopper cannot rotate about a through axis A of the feed collar 200 or move axially along the through axis A when the feed collar 200 is in a locked configuration. In general, neck 110 can define a through hole 111 which is colinear, shares the same diameter, and is coaxial with through holes in the feed collar 200 and the feed port 302 of the marker 300. The neck 110 can have an outer cross-sectional shape of a keyhole, as seen in FIG. 4. The keyhole shape can be generally understood as a circle 112*a*, shown as a solid line for illustration purposes only, with a rectangular portion 112*b*, shown as a solid line for illustration purposes only, extending off of one arc portion, as seen in at least FIG. 4. The circular portion 112*a* of the keyhole shape can be sized with a diameter that is larger than a diameter of the paintballs 400 to allow them to pass through to the paintball marker 300.

The rectangular portion 112*b* of the keyhole shape of the neck 100 can be sized to accommodate the spring-biased gate, generally referred to as 120, of the instant embodiment. The spring-biased gate 120, in the illustrated embodiment, is a V spring extending down from the bottom surface 109*b* of the lower surface 109 of the hopper 102. The upper end 122*a* of a first arm 122 of the V-spring can be embedded in the lower surface 109, as shown. The illustrated spring-biased gate is preferably a V-shaped spring, but the spring can be any known shape including a W-, U-, O-, S- J-, Z- C-, N-, or M-shape. The spring-biased gate 120 can be formed from any suitable material including, but not limited to, an elastic plastic and metals. In the illustrated embodiment, a first arm 122 of the V-spring 120 can extend down from a bottom surface, or rim, 109*b* of the hopper 102. The first arm 122 extends substantially parallel to the through axis A.

Figure 5:
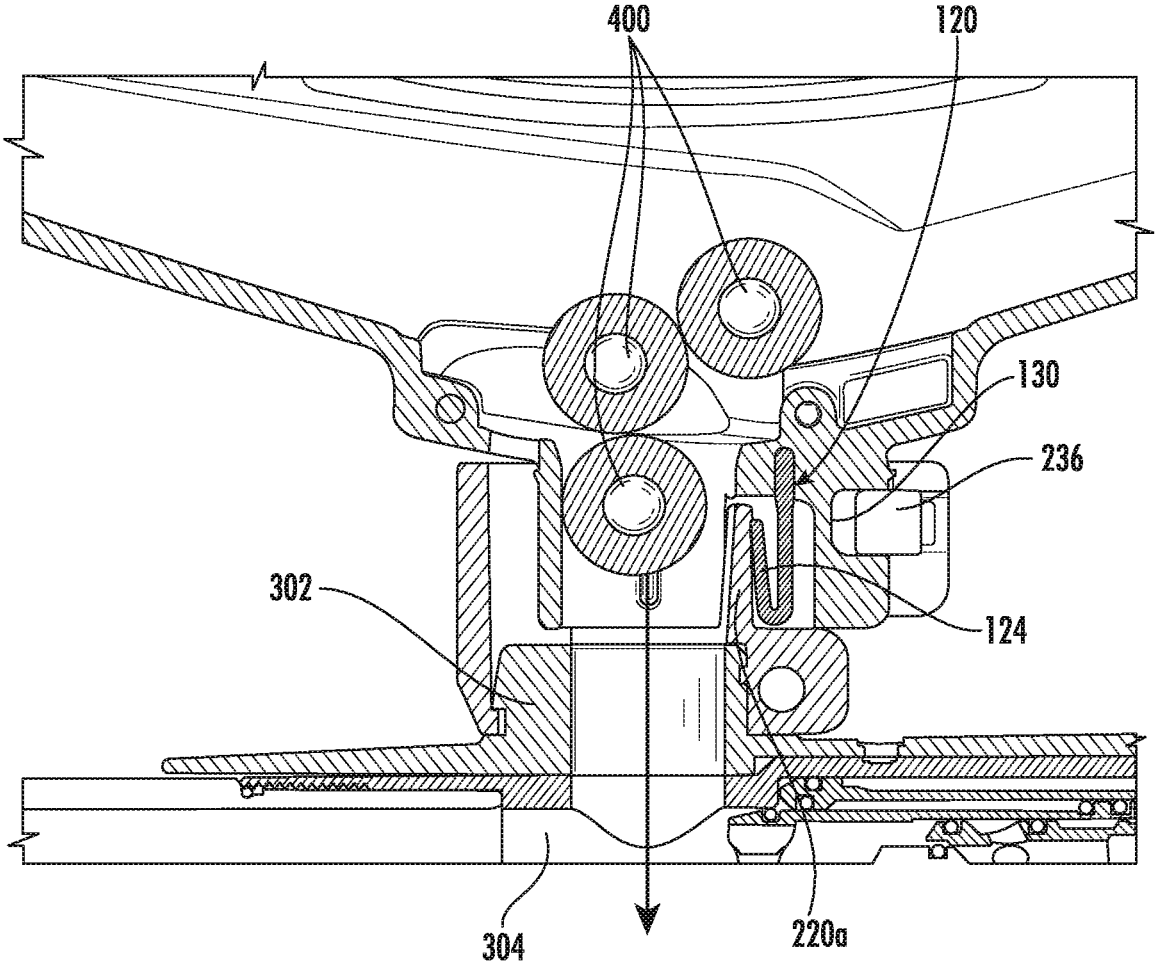
FIG. 5 is a cross-sectional view of the present invention showing operation of the present invention with the loader installed and spring-biased gate moved out of the path of paintballs.
Figure 6:
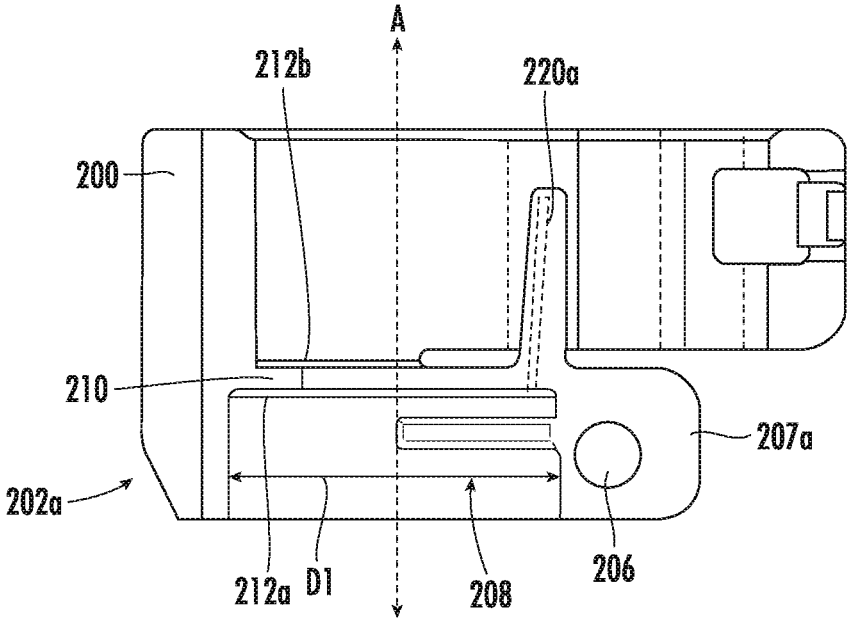
FIG. 6 is a cross-sectional view of the feed collar interface of the present invention.
Figure 7:
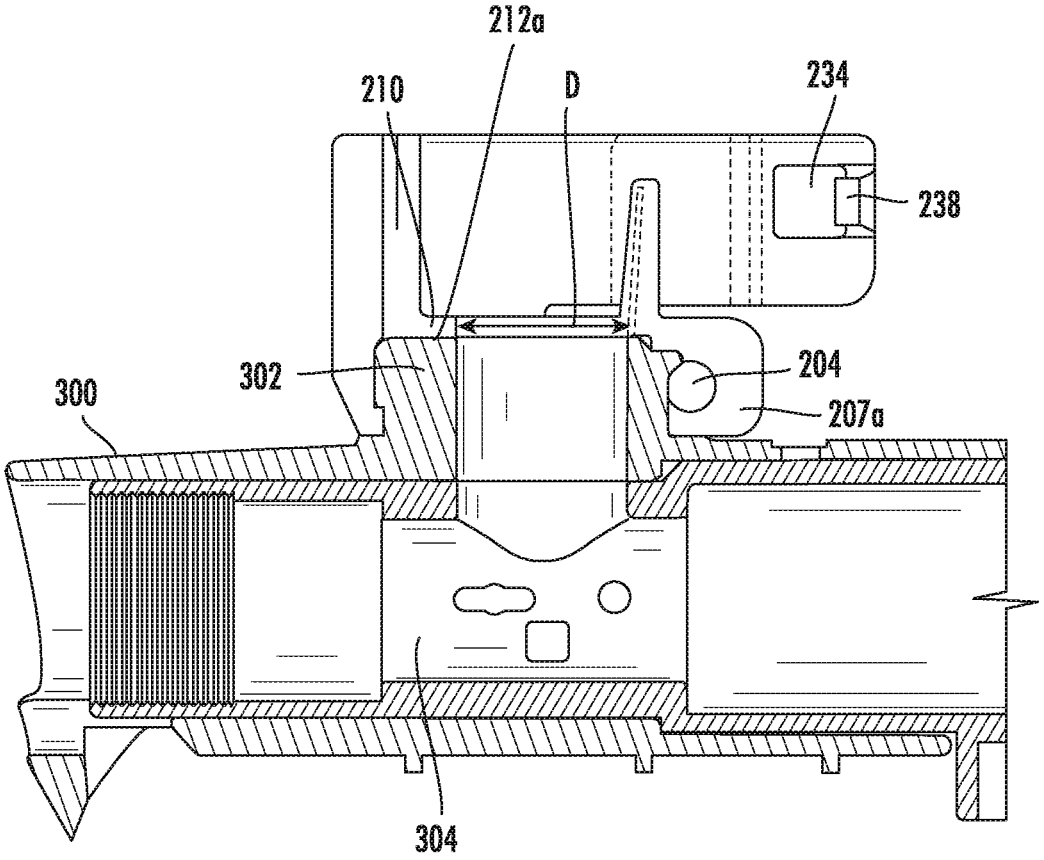
FIG. 7 is a cross-sectional view of the feed collar interface connected to the neck of the marker.

Alternatively, the first arm 122 can extend at an angle relative to the through axis A. The first arm 122 can extend downward, towards the paintball marker 300, to a lowest most point 122 from which a second arm 124 can extend upward and radially inward, relative to the through axis A, into the circular portion 112*a* of the keyhole. The first arm 122 of the spring 120 can be located in the rectangular portion 112*b* of the keyhole cross-section and the second arm 124 can extend from the rectangular portion 112*b* into the circular portion 112*a*. The amount that the second arm 124 extends is a function of diameter of the paintballs 400 that are intended to be blocked. In other words, the distance D between the end of the second arm 124*a* and the opposite side wall 144*a* of the neck 110 is less than the diameter of a paintball 400. When the gate 120 is in the expanded configuration, as shown in FIGS. 2-4, the gate 120 is configured to prevent any paintballs 400 from exiting the loader 100 through the feed neck 110, as seen in FIG. 2. Importantly, the gate 120 is configured to be elastically deformable, or actuatable, from the aforementioned blocking configuration, as shown in FIG. 2, to a deformed configuration where paintballs 400 are allowed to pass through the feed neck 110, as shown in FIG. 5. A close up cross-sectional view of the feed collar interface 200 is shown in FIG. 6. FIG. 7 shows the feed collar interface 200 installed on the neck 302 of a marker 300.

Advantageously, the gate 120 is configured to be biased into the locking configuration when the loader 100 is not attached to the feed collar 200 or the marker 300, as the rest state of the gate 120 is the expanded V-shape. As will be discussed below, the gate 120 is configured to be actuated, or deflected, into the second configuration when the neck 110 of loader 100 is inserted into the feed collar 200, as seen in FIG. 5.

It should be understood that the spring-biased gate 120 shown herein and discussed above is just one of many different configurations and structures that may be employed to controllably gate of the paintballs when the loader is not connected to the feed collar/paintball marker. The gate can be any structure that blocks the paintball path when the loader is not installed and does not block the path when the loader is installed. As a further example, the gating/blocking device may be a sliding gate, similar to a garage roller shutter door. As yet another example, the gating device may be a spring-operated lever arm. Therefore, a door may be provided to completely cover the outlet port of the loader so that it is completely sealed when separated from the paintball marker.

Also, the gating device of the present invention may also be configured and arranged in an electronic loader that includes a motor drive to help feed and load the paintballs from the loader and into the paintball marker. In this case, the gate may operate a switch that switches the motor drive of the electronic loader on and off. For example, when the loader is installed and ready to use and the gate (in whatever form) is positioned to permit paintballs to pass, a structure may be provided so that the gate actuates a switch to turn on the motor drive of the electronic loader. Similarly, when the loader is removed from the paintball gun, movement of the gate to now block the paintballs will switch off the motor drive.

The neck 110 of the loader 100 can additionally include a locking slot 130. The locking slot 130 can be located anywhere on the outer perimeter of the neck 100. In the illustrated embodiment, the locking slot 130 is located on a distally extending flange 132. The flange 132 can have a thickness t that is less than the thickness T of the rectangular portion 112*b* of the neck 110. The locking slot 130 can be in the form of a U- or C-shaped cut out that is sized to receive a locking cross bolt 236 of the feed collar 200, discussed further below. While the illustrated locking slot 130 has a rectangular, or square, shape the locking slot 130 can have any cross-sectional shape. Advantageously, when the loader 100 is inserted into feed collar 200 and the locking cross bolt 236 is engaged, the loader 100 can be fixed to the respective paintball marker 300. Thus, the loader 100 is secured to the marker 300 with the pathway from loader 100 to the marker being open thereby being ready for use by a user.

Figure 8:
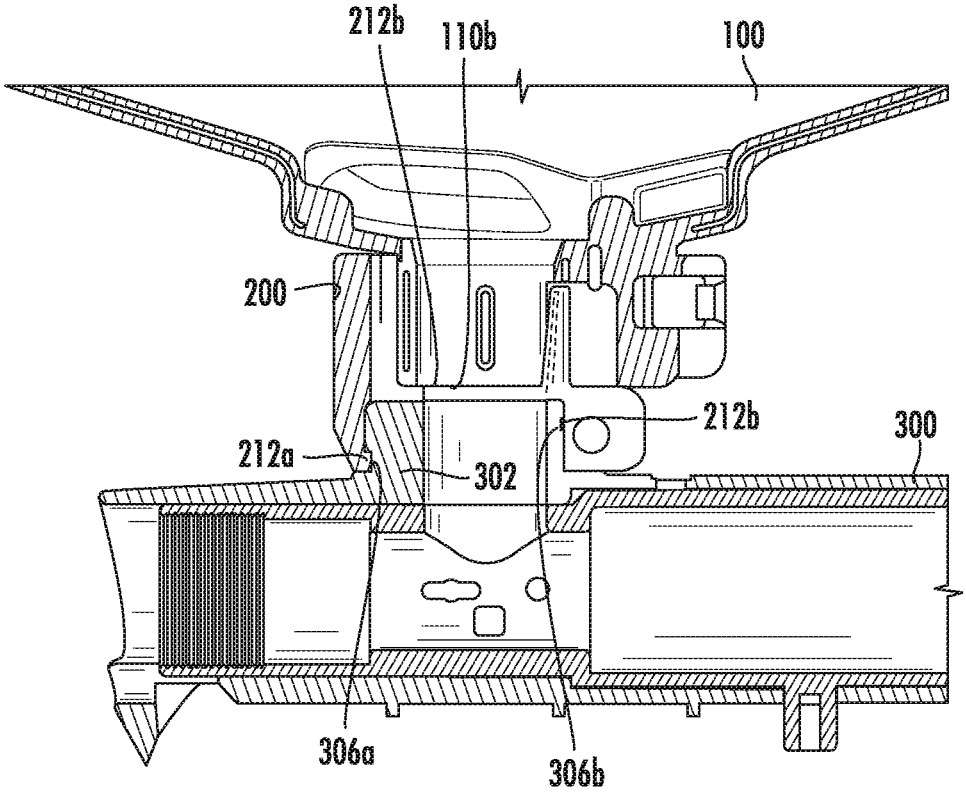
FIG. 8 is a cross-sectional view of the loader connected to the feed collar interface, which is connected to a marker, which the feed gate not shown for illustrative purposes only.

Looking to the feed collar 200 itself, the feed collar can be used to connect the loader 100 to the marker 300, to lock the loader 100 to the marker 300, and to move the gate 120 from the locked configuration to the released configuration. In general, the feed collar 200 acts as a bracket to connect the feed port 302, located in a top wall of the breech 304 of the marker 300, to the feed neck 110 of the loader 100, as seen in FIGS. 6-8.

The lower end 202*a* of the feed collar 200 can be configured as a clamp collar style bracket which can be tightened onto the feed port 302 of the paintball marker by rotation of the screw 204 through the through openings 206. The through openings 206 can be disposed in respective ears 207*a*, 207*b*, which are spaced a distance apart from one another by a gap which extends radially inward towards the central axis A of the feed collar. Thus, the lower end 202*a* of the feed collar 200 can have a variable diameter D1 lower through hole 208. By adjusting the screw 204, the diameter D1 can be enlarged or tightened around the feed port 302. As the screw 204 is tightened the gap is lessened, thereby reducing the variable diameter D1. The flange through hole 208 can extend upward towards an inner cylindrical flange 210. The inner cylindrical flange 210 can have a lower surface 212*a* define a stop which the feed port 302 can abut when fully inserted into the feed collar 200 to prevent an over insertion, as seen in FIG. 7. The inner cylindrical flange 210 can have an inner diameter that is substantially the same as the diameter D of the feed neck 110 of the loader 100 and an inner diameter of the feed port 302 of the marker 300. The common inner diameter D of the feed neck 110, inner cylindrical flange 210, and the feed port 302 permit for smooth passage of the paintballs from the loader 100 to the breech 304 of the marker 300. In some embodiments, the lower end 202 of the feed collar can have additional inner cylindrical ridges 212*a*, 212*b* to engage with grooves 306*a*, 306*b* of the feed port 302 to further secure the feed collar 200 to the marker 300 and prevent axial movement along the central axis A, as shown in at least FIG. 8, gate 120 not shown for illustrative purposes only.

Figure 9:
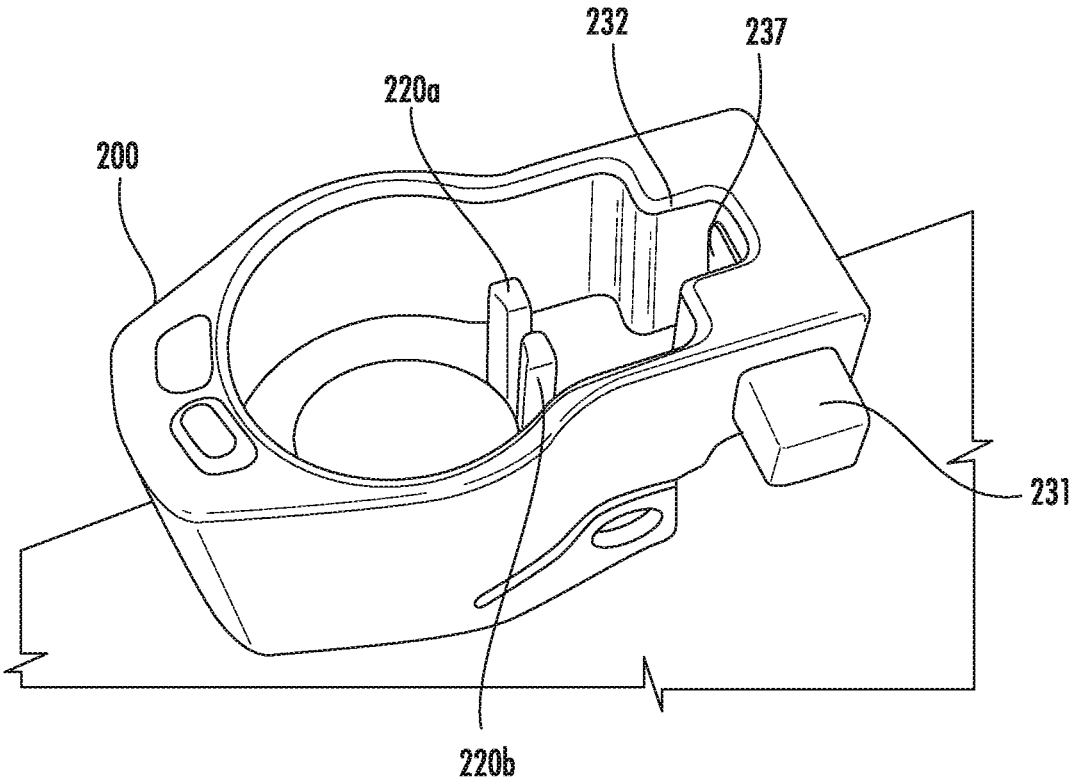
FIG. 9 is a top perspective view of the feed collar interface with sliding locking bolt.
Figure 10:
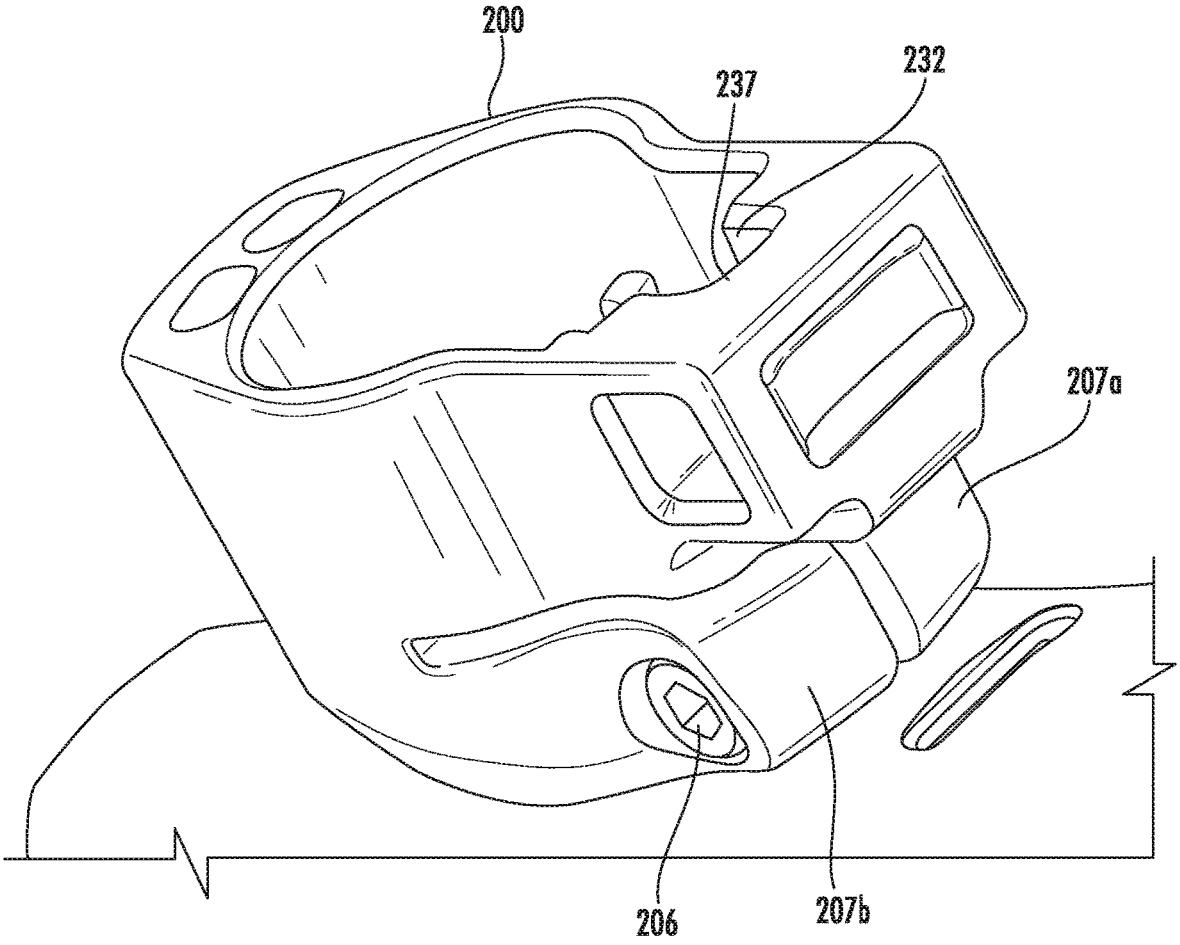
FIG. 10 is a side perspective view of the feed collar interface.

At the upper end 202*b* of the feed collar 200, there can be a keyhole like cross-section to match the outer cross section of the feed neck 110 of the loader 100, as seen in at least FIG. 9. The corresponding non-circular cross-sections of the outer surface of the feed neck 110 and the inner surface of the feed collar 200 can prevent rotation of the loader 100 about the axis A, relative to the feed collar 200 and can ensure that the loader 100 is inserted in the correct orientation. The lower most surface 110*b* of the feed neck 100 can abut the upper surface 212*b* of the inner cylindrical flange 210 to prevent over insertion of the loader 100 in the feed collar 200, as seen in FIGS. 5 and 8.

Proximate to the respective ears 207*a*, 207*b*, are two upstanding deflection posts 220*a*, 220*b* which can extend upward from an outer edge of the inner cylindrical flange 210. While two deflection posts 220*a*, 220*b* are shown one or any number of posts can be used. The two deflection posts 220*a*, 220*b* are arranged such that upon insertion of the neck 110 of the loader 100 into the feed collar 200, the second arm 124 of the spring-biased gate 120 can be deflected, or pivoted in the direction R, seen in FIG. 3, into the "unlocked" configuration, as shown in FIG. 5. In the "unlocked" configuration, the paintballs 400 are able to pass through the feed path 111 of the loader 100.

Figure 20:
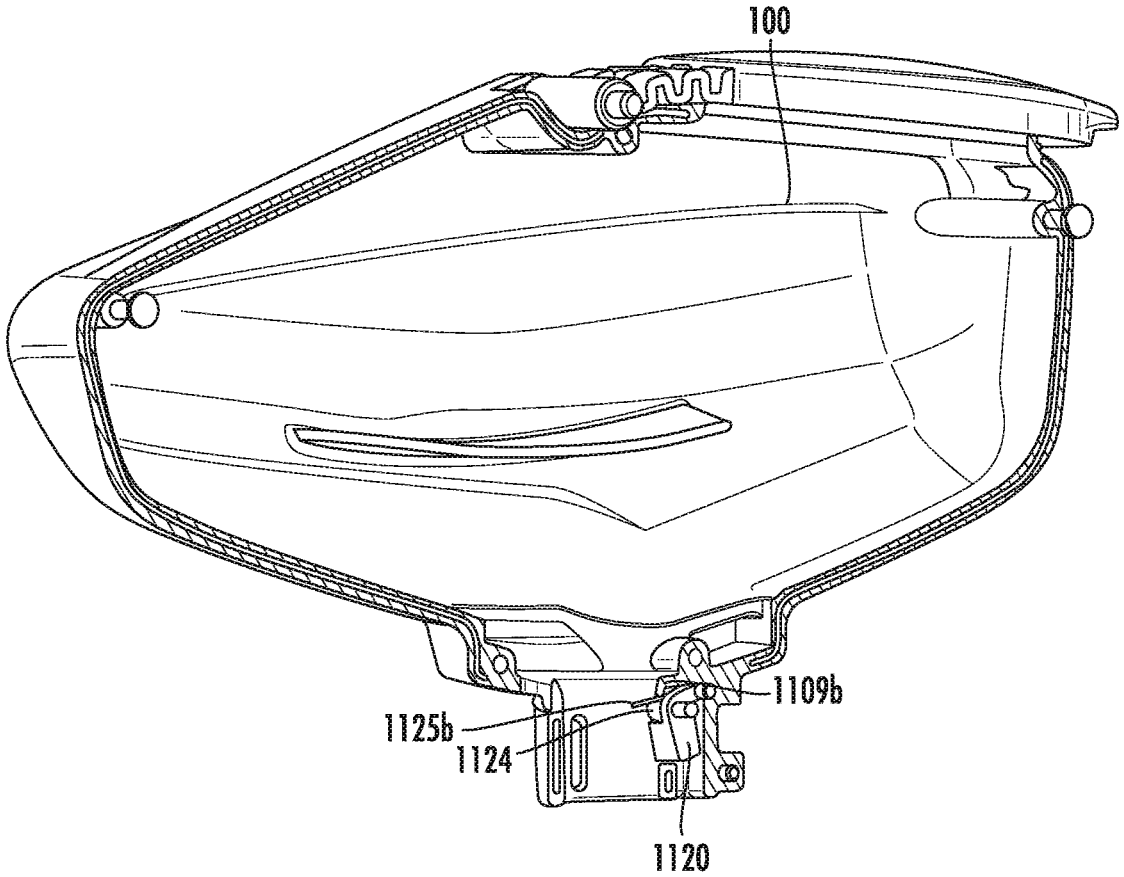
FIG. 20 is a perspective view of a second exemplary embodiment having an alternative gate.
Figure 21:
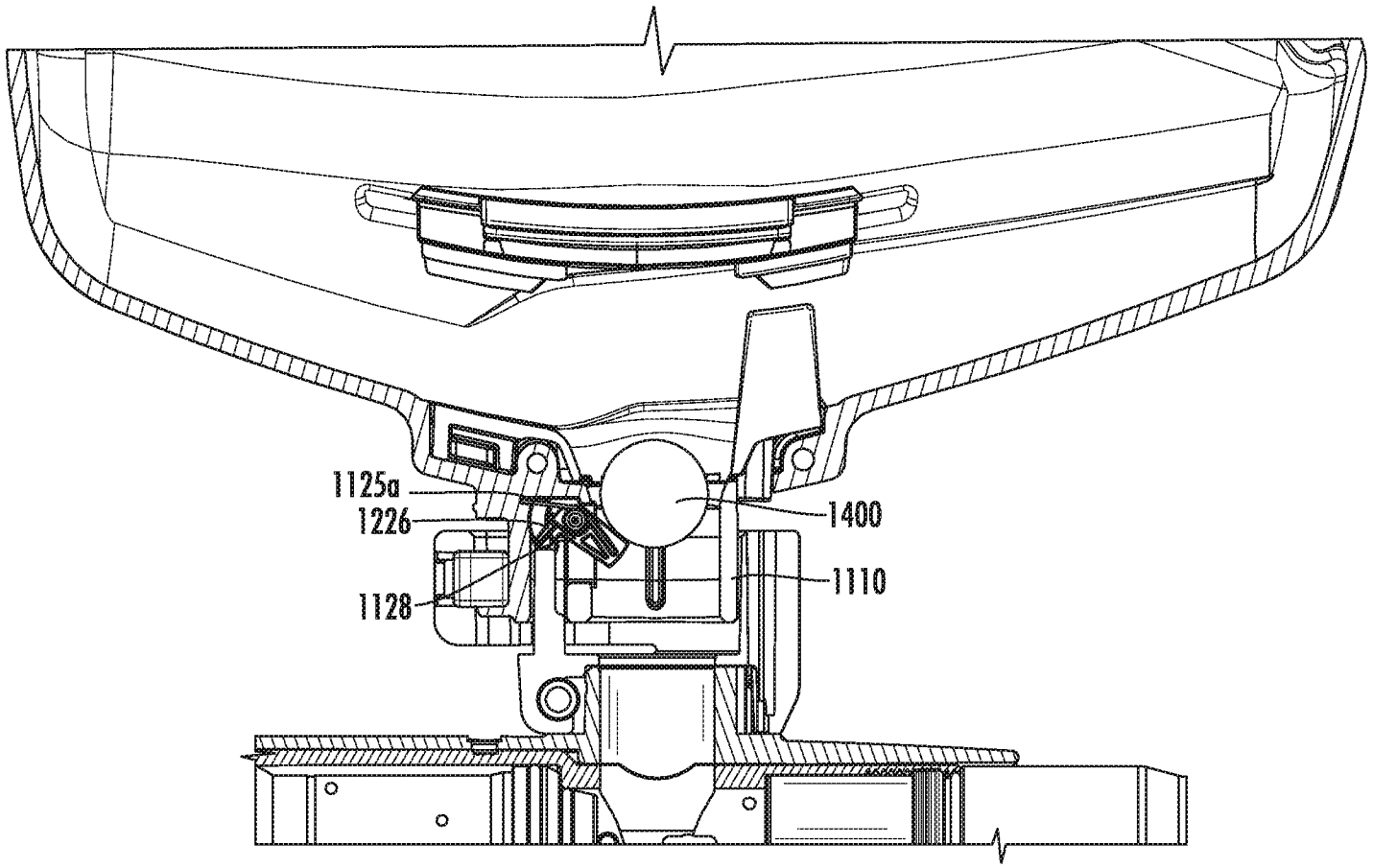
FIG. 21 is a partial cross-sectional view of the second exemplary embodiment of FIG. 20 in a closed configuration.
Figure 22:
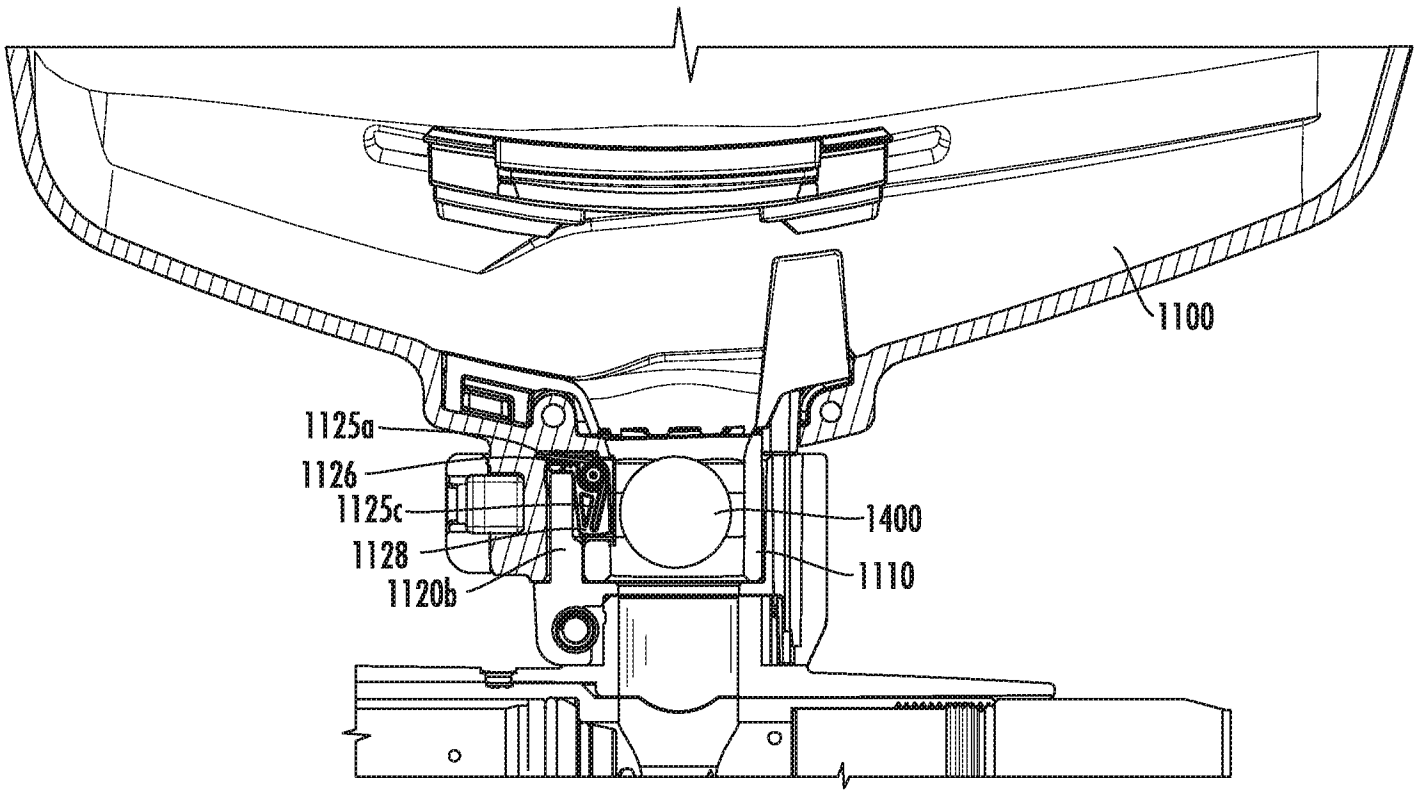
FIG. 22 is a partial cross-sectional view of the second exemplary embodiment of FIG. 20 in an open configuration.
Figure 23:
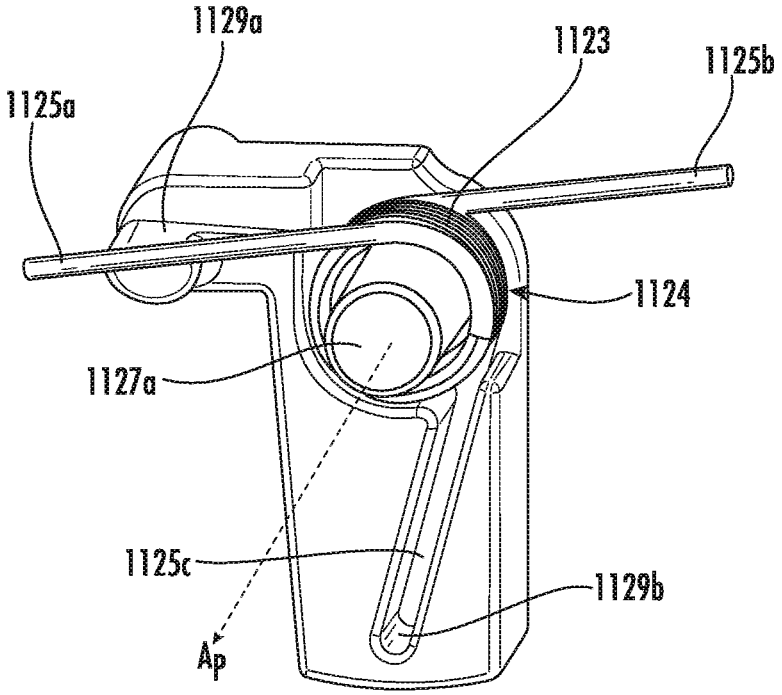
FIG. 23 is a perspective view of the alternative gate of FIG. 20.

While an embodiment of the spring-biased gate is shown in FIGS. 1 to 19 to be a multi-segment spring member, the gate 120 can be modified in many different ways to carry out the present invention. For example, in FIGS. 20 to 23, an alternative embodiment of gate 1120 is shown. This gate 1120 employs a generally "L" shaped rigid member 1122 that rotates about an axis $A_P$ and is spring-biased, by a torsion spring 1124, and shown in an open condition in FIG. 20. In the illustrated embodiment, the gate 1120 is shown as a single unitary piece to be used in conjunction with the torsion spring 1124. Alternatively, the gate 1120 can be formed from a plurality of parts. As in the embodiment above, the deflections posts 1220*a*, 1220*b* hit a lower portion 1126 of the gate 1120 and then urge rotation of the gate 1120 against the forces of the spring so that portion 1128 moves into the path of the paintballs 1400 when the loader is installed.

As noted above, the gate 1120 can include a first arm 1126 and a second arm 1128 which intersect to form the generally "L" shape. The first arm portion 1126 can be a shorter length than the second arm portion 1128, as the first arm portion can be sized to rotate within the feed neck 1110 of the loader 1100. In the illustrated embodiment, a pivot pin 1127 can be rigidly formed with, or attached about the pivot point of the gate 1120 and can be longer than a width of the gate 1120. The pivot pin 1127 can have a diameter that is sized to be received within retaining holes in the feed neck 1110, to allow the gate 1120 to freely pivot therewith. On one side of the gate 1120, a spring groove 1129 can be formed to receive and catch an arms of the spring. In general, the torsion spring 1124 can be a double helical spring having at least three arms 1125*a*, 1125*b*, 1125*c* and a helical portion 1123. The helical portion 1123 can be disposed about a portion of the pivot pin 1127*a* which is longer than a portion of the pivot pin on the other side of the gate 1120. In general, the helical portion 1123 can have a minimum inner diameter that is at least the same as, or larger than, the outer diameter of the pivot pin 1127. A first arm 1125*a* of the torsion spring 1124 can rest in a groove 1129*a*, can rest against a lower surface 1109*b* of the hopper, as seen best in FIG. 20. The torsion spring is configured to urge the gate towards a blocking configuration in the feedtube when the deflection posts 1220*a* and 1220*b* are removed It should be further noted that other gate constructions are contemplated in accordance with the present invention that can deflected out of the path of paintballs upon installation of the loader to the marker.

In the illustrated embodiment, the loader 100 is installed whereby the feed neck 110 of the loader 100 is inserted into the feed collar 200 so that upstanding deflection posts 220*a*, 220*b* deflect the second arm 124 of the spring-biased gate 120. As the second arm 124 is deflected, it no longer extends into the circular portion 122*a* through hole to allow the paintballs 400 to exit from the loader 100, through the feed neck 110 and then into the breech 302 of the paintball marker 300.

Figure 13:
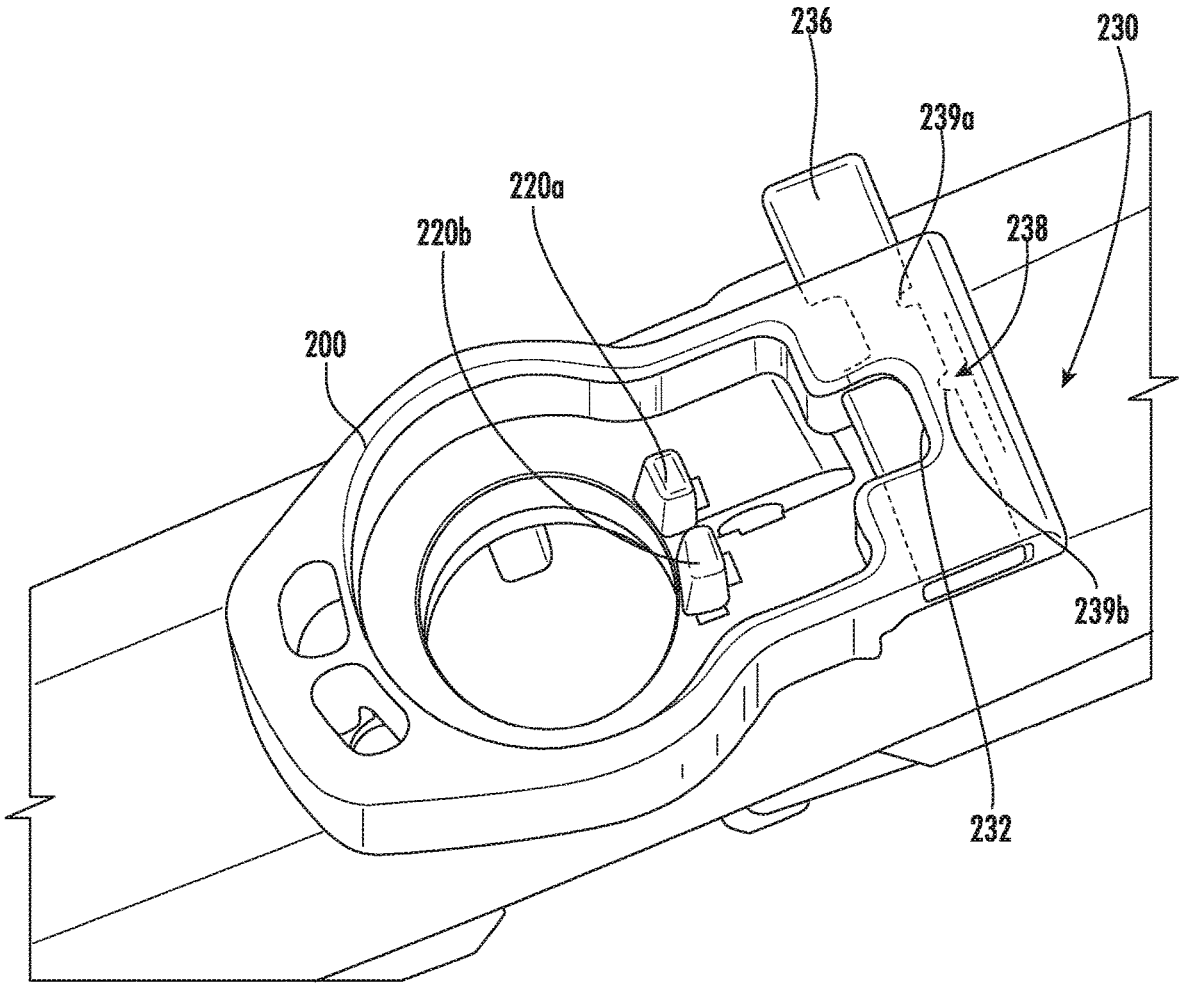
FIG. 13 is a top perspective view of the feed collar interface and locking cross-bolt.
Figure 14:
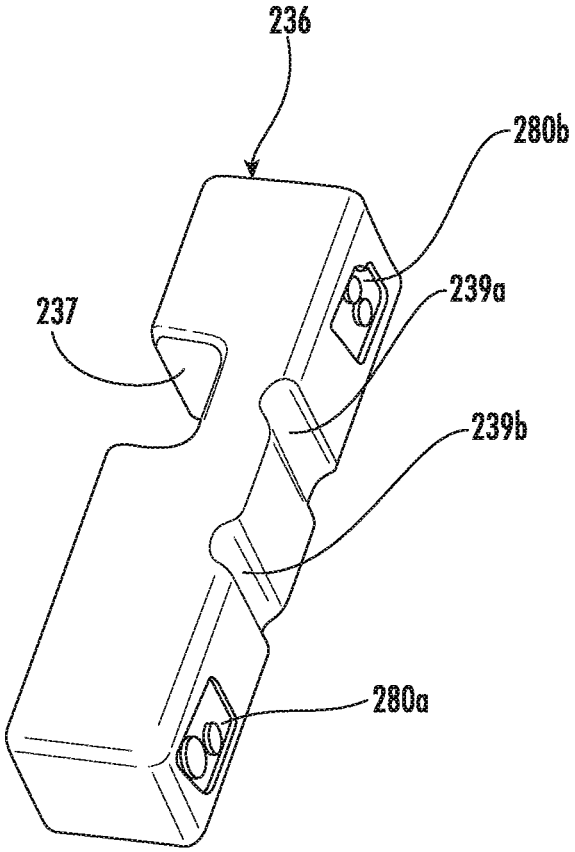
FIG. 14 is a perspective view of the cross-bolt.

Once the feed neck 110 of the loader 100 is disposed in the feed collar 200, the loader 100 locks to the feed collar 200. As shown in FIGS. 5 and 13, the feed collar 200 can additionally include a lock 230. The lock 230 includes a locking seat 232 which can be a vertical cut out sized and shaped to receive the flange 132 of the loader 100, when the lock is in the unlocked configuration. Additionally, the lock 230 includes a pass-through port 234 which has a generally rectangular cross section. On a rear interior face 235 of the pass-through port 234 are disposed a flexible locking detent 238. The locking detent 238 is configured to restrict movement of a locking cross-bolt 236 through at least the pass-through port 234. It should also be noted that the locking detent 238 is preferably formed in the body of the feed collar 200 on a flexible strap-like member to provide some spring-biasing. With some light pressure, the locking bolt 236 may be moved laterally to unseat the detent 238 from one groove 239*a*, 239*b* and permit further travel of the cross-bolt 236 so the detent 238 may engage with the other groove. Lateral sliding of the cross-bolt 236 can be carried out easily and without tools and it will stay in place during game play. Therefore, locking and unlocking may be easily achieved to facilitate removal and installation of a loader 100 in accordance with the present disclosure.

The locking cross-bolt 236 is generally rectangular in shape and includes a recess 237 through one face. The recess 237 has a cross-sectional shape and dimension that is substantially the same as the cross-sectional shape and dimension of the locking seat 232. When the recess 237 is aligned with the locking seat 232 the flange 132 is able to move vertically relative to the feed collar 200, as shown in FIG. 9—whether for insertion or removal of the loader 100 from the feed collar 200. When the recess 237 is not aligned with the locking seat 232, the body of the locking cross-bolt 236 interferes with the locking slot 130 to prevent vertical movement of the loader 100 relative to the feed collar 200, as shown in FIG. 3. Additionally, or alternatively, the locking cross-bolt 236 can include vertical grooves 239*a*, 239*b* on an opposite face from the recess 237. The grooves 239*a*, 239*b* are sized to receive the aforementioned locking detent 238. The two grooves 239*a*, 239*b* can define the locked and unlocked positions of the locking cross-bolt 236. On at least one face of the locking cross-bolt 236 there can be glyphs 240*a*, 240*b* which can visually indicate to the user whether the lock 230 is in the locked or unlocked configuration.

When the loader 100 is disposed in the feed collar 200, the locking slot 130 and the pass-through port 234 are aligned. The locking slot 130 can be arranged, relative to the feed collar 200, such that the locking cross-bolt 236 can slide through both the locking slot 130 and the pass-through port 234 at the same time, as seen in FIG. 5. The lock 230 can be configured such that itis able to prevent vertical movement of the loader 100 relative to the feed collar 200 (and the paintball marker 300 to which it is attached). Thus, the loader 100 is locked to the paintball marker 300.

Figure 11:
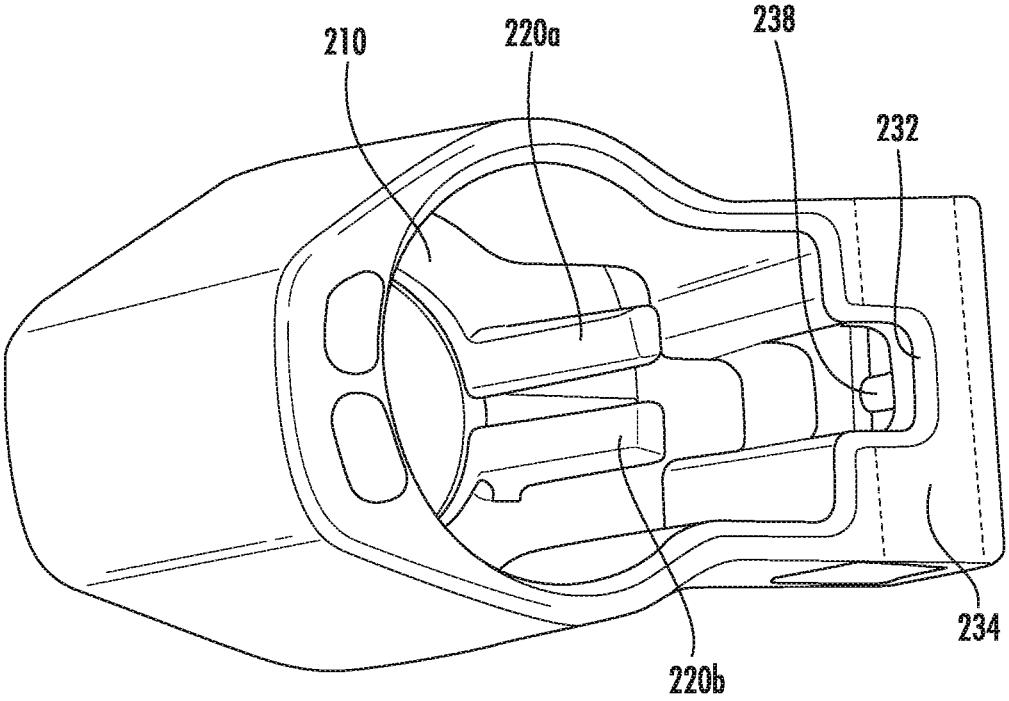
FIG. 11 is a further perspective view of the feed collar interface showing the deflection posts and locking seat.
Figure 12:
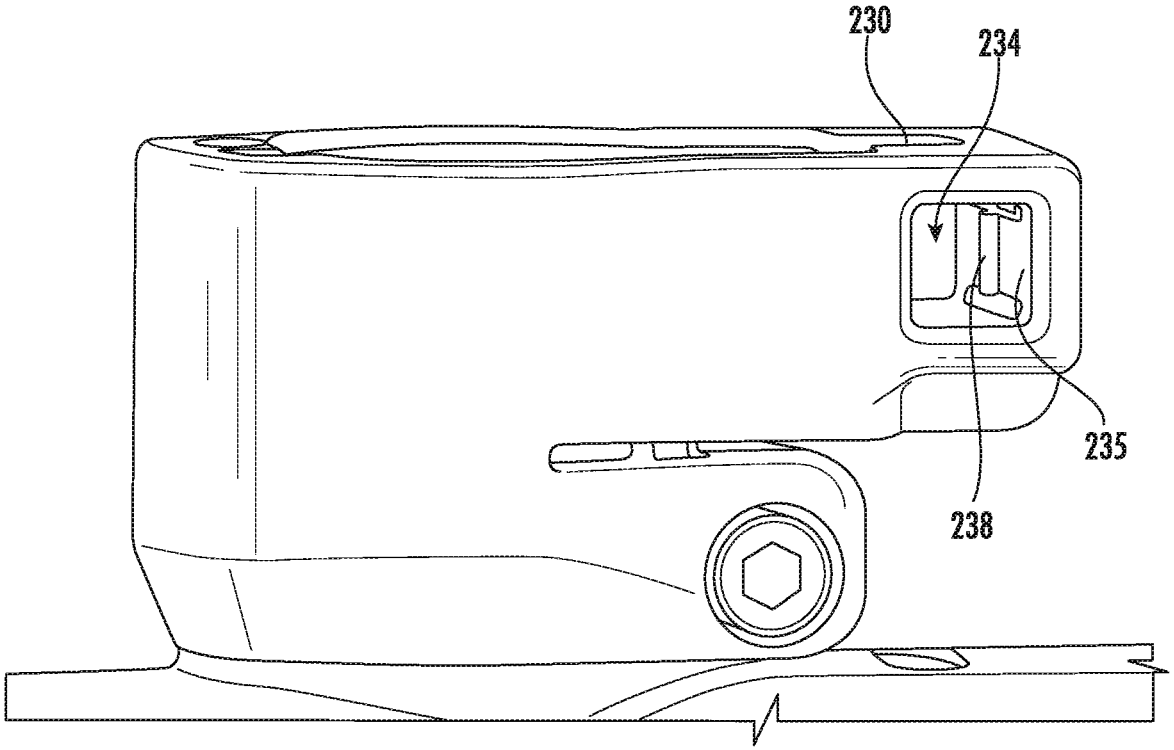
FIG. 12 is a side elevational view of the feed collar interface.

When the locking cross-bolt 236 is moved through the pass-through port 234 to its unlocked position, as shown in FIG. 11, the entire loader 100 may then be freely separated from the paintball marker 300. As the loader 100 is removed from the marker 300, the deflection posts 220*a*, 220*b* are no longer urging the gate 112 up and out of the way of the paintball path because the loader has been disconnected and the gate 112 now blocks the path of the paintballs 400 thereby preventing unwanted escape of paintballs 400.

Figure 15:
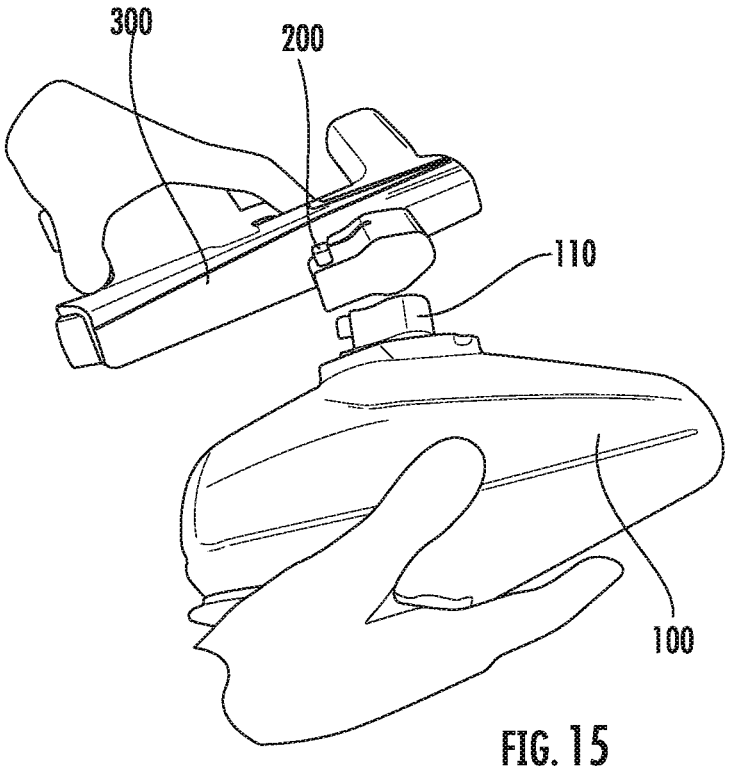
FIG. 15 is a perspective view showing free separation of the loader from the feed collar and paintball marker to which it is connected in accordance with the present invention.

FIGS. 15-19 show one exemplary use of the present invention. In FIG. 15, a loader 100 is shown unattached to the feed collar 200 and the marker 300. In this configuration, the second arm 124 of the spring biased gate 120 is in the paintball pathway 111, such that none of the paintballs 400 can exit the loader. A user can then orient the loader 100 for insertion into the feed collar 200, as shown. Advantageously, due to the spring biased gate 120, the user can orient the loader into any orientation without fear of the paintballs 400 falling out.

Also, it is common for a user to pre-fill multiple loaders with paintballs. Filled loaders, when not in use, are commonly attached to user's belt or clothing. When the current loader is empty, the user can easily replace the current loader with a new filled loader. Therefore, it is common to handle and move around pre-filled loaders. With the use of the spring-biased gating of the present invention, pre-filled loaders can be easily handled without fear of paintballs falling out. This is especially useful during paintball competitions.

Figure 16:
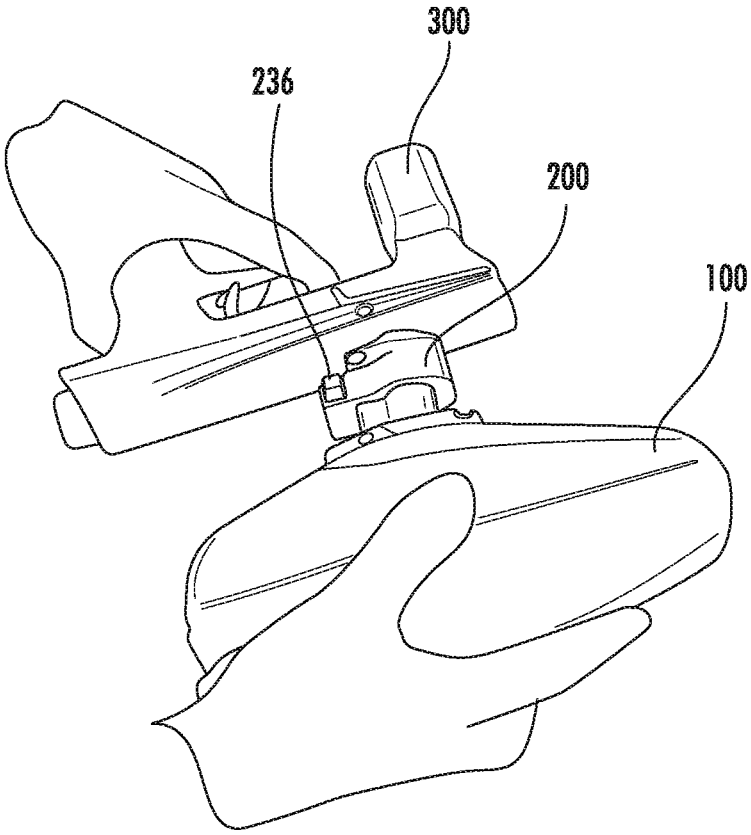
FIG. 16 is a perspective view showing partially reattachment of the loader to the feed collar.
Figure 17:
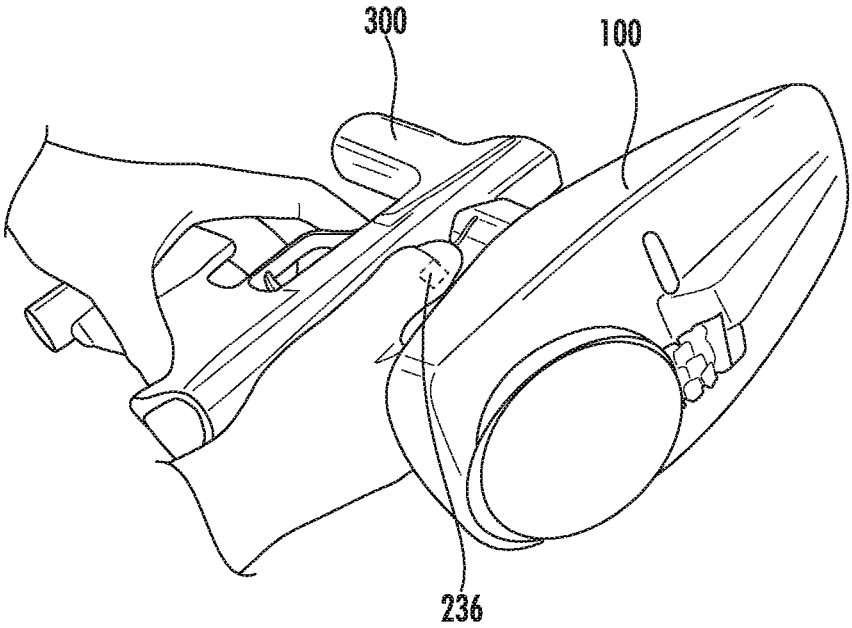
FIG. 17 is a perspective view showing locking of the loader to the feed collar by sliding the locking cross-bolt by pressing it.

As shown in FIG. 16, the feed neck 110 of the loader is inserted into the feed collar 200 such that the flange 132 of the loader 100 is inserted into the locking seat 232 of the feed collar 200, as in FIGS. 5 and 8. The locking slot of the flange of the loader is now laterally aligned with the pass-thru port of the locking collar. Next, as shown in FIG. 17, the locking-crossbolt 236 can be pushed through the pass-thru port 234 such that the recess 237 of the cross bolt 236 is no longer aligned with the locking slot 130 of the loader. In this configuration, the locking cross bolt 236 will also pass through the locking seat of the flange and vertical movement of the loader 100 will be prevented thereby locking the loader 100 on the marker 300.

Figure 18:
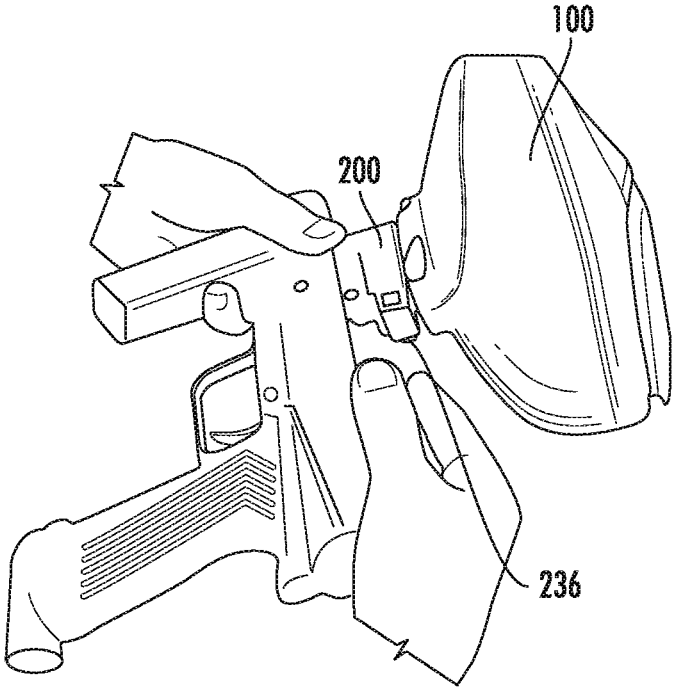
FIG. 18 is a perspective view showing the loader locked on to the marker.
Figure 19:
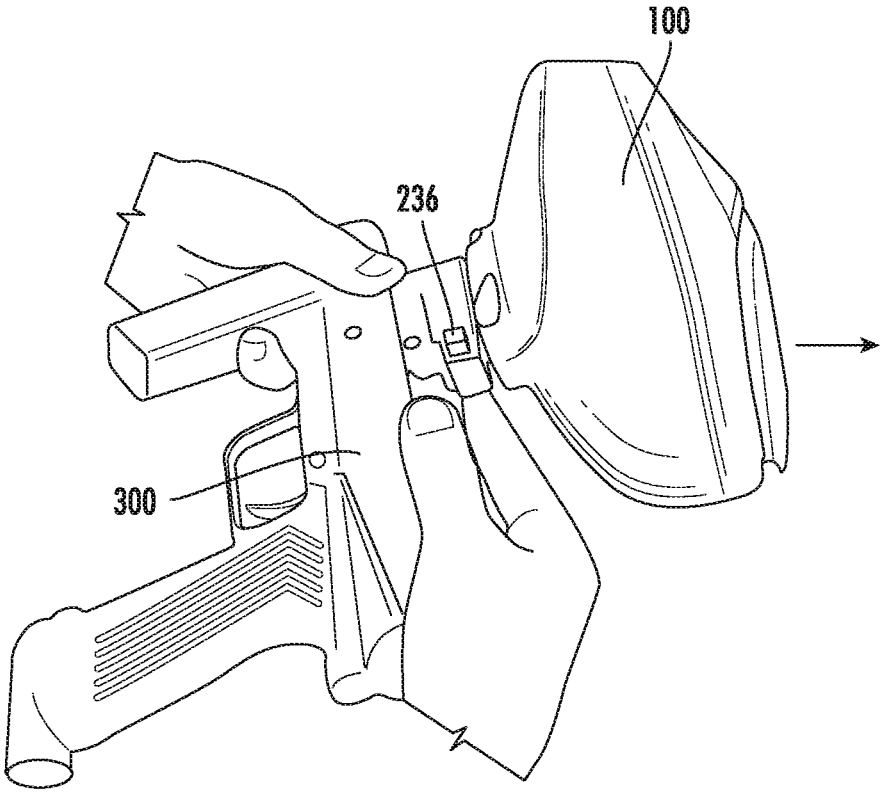
FIG. 19 is a perspective view showing moving the locking cross-bolt to an unlocked position.

This is made possible by the two-position locking cross-bolt 236. The cross-bolt recess 237, when aligned with the locking slot 130 of the loader allow the loader to move vertically, i.e. separated from the paintball marker 300. When not aligned, the cross-bolt 236 resides in the locking slot 130 of the flange thereby prevented such vertical movement and separation. While two positions are shown, it is contemplated that there may be additional positions as needed. As is shown in FIG. 13, grooves 239*a*, 239*b* are preferably provided. When, for example, groove 239*b* is engaged with the spring-biased internal detent 238, the cross-bolt can be disposed in the locking seat 232. If the cross-bolt is moved laterally so that the detent 238 on the feed collar 200 is resting in groove 239*a*, it can be understood that the locking seat will be fully open because the recess 237 of the locking bolt 236 is aligned with the locking seat 232 of the feed collar and the locking slot of the flange of the loader. Therefore, the loader can be freely separated from the feed collar (and paintball marker attached to the feed collar). To unlock the loader 100 from the paintball marker 300, the locking bolt 236 can be pushed in the opposite direction, as shown in FIG. 18, to the unlocked position shown in FIG. 19, and thus the loader 100 can be removed from the feed collar 200 by pulling the loader 100 in the direction U.

It will be appreciated by those skilled in the art that various changes and modifications can be made to the illustrated embodiments without departing from the spirit of the present disclosure. All such modifications and changes are intended to be covered by the appended claims.

What is claimed is:

1. A loader mechanism, comprising:

a loader having a feed neck having a paintball path;

a spring-biased gate pivotally connected to the feed neck and partially disposed in the paintball path in a first configuration and, in a second configuration, not in the paintball path; and a feed collar disposed on a paintball marker, the feed collar including at least one deflection post connected to the feed collar configured and arranged to actuate the spring-biased gate, wherein the at least one deflection post extends substantially parallel to the paintball path;

wherein insertion of the feed neck into the feed collar causes the at least one deflection post to compress the spring-biased gate to pivot from the first configuration to the second configuration, and wherein the paintball path extends perpendicular to a breech of the paintball marker.

2. The loader mechanism of claim 1, wherein the spring-biased gate is a V-shaped spring.

3. The loader mechanism of claim 1, wherein the spring-biased gate is a lever arm.

4. The loader mechanism of claim 1, wherein the feed neck includes a flange having a transverse locking slot.

5. The loader mechanism of claim 4, wherein the feed collar further includes a locking slot with a locking cross-bolt slidably residing therein.

6. The loader mechanism of claim 5, wherein the locking cross-bolt is configured to slide within the locking slot and the transverse locking slot to lock the feed neck to the feed collar.

7. The loader mechanism of claim 5, wherein the locking cross-bolt includes at least one vertically oriented groove, parallel to paintball path.

8. The loader mechanism of claim 7, wherein the locking slot includes at least one spring biased detent configured and arranged to engage the at least one vertically oriented groove to prevent the locking cross-bolt from sliding within the locking slot.

9. The loader mechanism of claim 1, wherein the loader is configured and arranged to maintain paintballs therein in any orientation when not disposed in the feed collar.

10. A loader assembly for a paintball marker, comprising:

a loader having a feed neck having a paintball path; and a feed collar disposed on a feed port of a paintball marker, the feed collar is disposed between the loader and the feed port, the feed neck includes a flange having a transverse locking slot;

wherein the feed neck is inserted into the feed collar;

wherein the feed collar further includes a locking slot with a locking cross-bolt slidably residing therein; and wherein the locking cross-bolt is configured to slide within the locking slot and the transverse locking slot to lock the feed neck to the feed collar.

11. The loader assembly of claim 10, further comprising, a spring-biased gate connected to the feed neck and partially disposed in the paintball path in a first configuration and, in a second configuration, not in the paintball path.

12. The loader assembly of claim 11, wherein the feed collar further includes at least one deflection post connected to the feed collar configured and arranged to actuate the spring-biased gate.

13. The loader assembly of claim 12, wherein insertion of the feed neck into the feed collar causes the at least one deflection post to push the spring-biases gate from the first configuration to the second configuration.

14. The loader assembly of claim 10, wherein the locking cross-bolt includes at least one vertically oriented groove, parallel to paintball path.

15. The loader assembly of claim 14, wherein the locking slot includes at least one spring biased detent configured and arranged to engage the at least one vertically oriented groove to prevent the locking cross-bolt from sliding within the locking slot.

* * * * *